US006065227A

United States Patent [19]

Chen

[11] Patent Number: 6,065,227

[45] Date of Patent: May 23, 2000

[54] WATERPROOF FOOT COVERING

[76] Inventor: Eddie Chen, 4F-3, No. 255, Sec. 1, Taichung-Kang Rd., Taichung City, Taiwan

[21] Appl. No.: 09/209,597

[22] Filed: Dec. 11, 1998

Related U.S. Application Data

[63] Continuation-in-part of application No. 08/829,931, Mar. 31, 1997, abandoned.

[51] Int. Cl.[7] ..... A43B 1/10

[52] U.S. Cl. ..... 36/4; 36/55; 12/142 A; 12/142 E

[58] Field of Search ..... 36/4, 14, 55; 12/142 A, 12/142 E

[56] References Cited

U.S. PATENT DOCUMENTS

| | | |
|---|---|---|
| 32,575 | 6/1861 | Meyer . |
| 967,064 | 8/1910 | Savage . |
| 1,725,749 | 8/1929 | Blair . |
| 2,200,333 | 5/1940 | Herzog et al. . |
| 2,306,306 | 12/1942 | Ferrettie . |
| 2,428,626 | 10/1947 | Jaeger et al. . |
| 3,668,056 | 6/1972 | Hayes, Jr. . |
| 4,599,810 | 7/1986 | Sacre . |
| 4,707,874 | 11/1987 | Champagne . |
| 5,526,584 | 6/1996 | Bleimhofer et al. . |
| 5,678,326 | 10/1997 | Pavelescu . |
| 5,778,473 | 7/1998 | Chen . |

FOREIGN PATENT DOCUMENTS

| | | |
|---|---|---|
| 2526668 | 11/1983 | France . |
| 607267 | 12/1934 | Germany . |
| 52613 | 5/1933 | Norway . |

*Primary Examiner*—Ted Kavanaugh
*Attorney, Agent, or Firm*—Fish & Richardson P.C.

[57] ABSTRACT

A waterproof foot covering has a breathable upper enclosure of an upper, a waterproof inner lining sleeve to line the upper enclosure, and a waterproof lower enclosing shell of a lower. The bottom open end of the upper enclosure, the bottom open end of the inner lining sleeve and the upper open end of the lower enclosing shell are interconnected together by sewing, thereby forming a stitched seam. A waterproof seam-sealing member is disposed inwardly of the stitched seam. The seam-sealing member is attached to the inner surfaces of the inner lining sleeve and the lower enclosing shell, whereby water-permeation through the stitched seam from a location between the inner lining sleeve and the upper enclosure to the exterior of the upper enclosure is permitted while water-permeation through the stitched seam to the interior of the inner lining sleeve and the lower. In a method for providing the seam sealing member, the upper enclosure, the inner lining sleeve and the lower enclosing shell for the stitched seam is also disclosed.

10 Claims, 4 Drawing Sheets

WATERPROOF FOOT COVERING

CROSS-REFERENCE TO RELATED APPLICATION

This is a continuation-in-part (CIP) of U.S. patent application Ser. No. 08/829,931 filed on Mar. 31, 1997, and abandoned as of the filing date of the application.

BACKGROUND OF THE INVENTION

1. Field of the Invention

The invention relates to a foot covering such as a boot, more particularly to an air-permeable or breathable, waterproof foot covering.

2. Description of the Related Art

In order to achieve moisture or air permeation, most boots have their shells made of natural leather, a moisture-permeable synthetic leather or fabric, or a combination of these materials. These materials are tailored to form pieces of particular shapes and are then bound together by a sewing process. Such shell construction provides good permeability for air and moisture which contributes dryness and comfort in the interior of the boot.

When it is desired to obtain a waterproofing effect, the moisture-permeable material has to be treated by a special process in order to make the upper waterproof, and the stitched seams in the upper should be sealed by using waterproof sealing means, such as a water-proof adhesive coating, an adhesively-bonded waterproofing strap, etc. However, the treatment process of the material is costly and the presence of the waterproof sealing means results in a loss of moisture-permeable or breathable characteristics of the boot.

There is a boot construction in which a sock-like lining sleeve made of waterproof and breathable fabric or the like is used inside the boot. The lining sleeve extends from the upper to the lower of the boot so as to line both the upper and lower. In this construction, both the upper and lower still have to be made of an expensive air-permeable or breathable, waterproof material, and the stitched seams in the upper have to be sealed with a waterproof material in order to provide a water-proofing effect. Otherwise, water or moisture can intrude between the lining sleeve and the upper and between the lining sleeve and the lower, resulting in an increased weight of the boot. In some cases, the water or the wetted part between the lining sleeve and the upper or lower can produce noise when the wearer walks. The same problems exist in a waterproof boot in which a lasted lining sleeve is provided inside a lasted boot in order to achieve a waterproofing effect. This boot still has to employ an upper and lower which is made of an expensive air-permeable waterproof material and whose stitched seams have to be sealed so as to ensure a good waterproofing effect.

SUMMARY OF THE INVENTION

Therefore, the main object of the present invention is to provide a foot covering which exhibits good air-permeability as well as a satisfactory waterproofing effect.

Another object of the present invention is to provide a waterproof boot with an upper thereof made of a non-waterproof air-permeable or breathable material which is inexpensive.

According to the present invention, a foot covering comprises: an upper having an upper enclosure which includes a top open end and a bottom open end and which is formed from a plurality of tailored parts that are stitched to each other; a lower having a lower enclosing shell which is made of a molded waterproof material, the lower enclosing shell including an upper open end, a lower end, a toe portion, and a heel portion connected to the toe portion between the upper open end and the lower end, the lower end having an access opening; an inner lining sleeve which is made of a waterproof material, disposed inside the upper enclosure to line the upper enclosure, the inner lining sleeve having a bottom open end that extends along the bottom open end of the upper enclosure; stitched seam means provided among the upper, the inner lining sleeve and the lower to interconnect the bottom open end of the upper enclosure, the bottom open end of the inner lining sleeve and the upper open end of the lower enclosing shell; seam sealing means provided along the stitched seam between the inner lining sleeve and the lower enclosing shell, the seam sealing means being in contact with inner surfaces of the inner lining sleeve and the lower enclosing shell for preventing water permeation through the stitched seam into the interior of the inner lining sleeve and the lower enclosing shell, the stitched seam being water-permeable in an outward direction from a location between the inner lining sleeve and the upper enclosure; and an outsole attached to the lower end of the lower enclosing shell.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
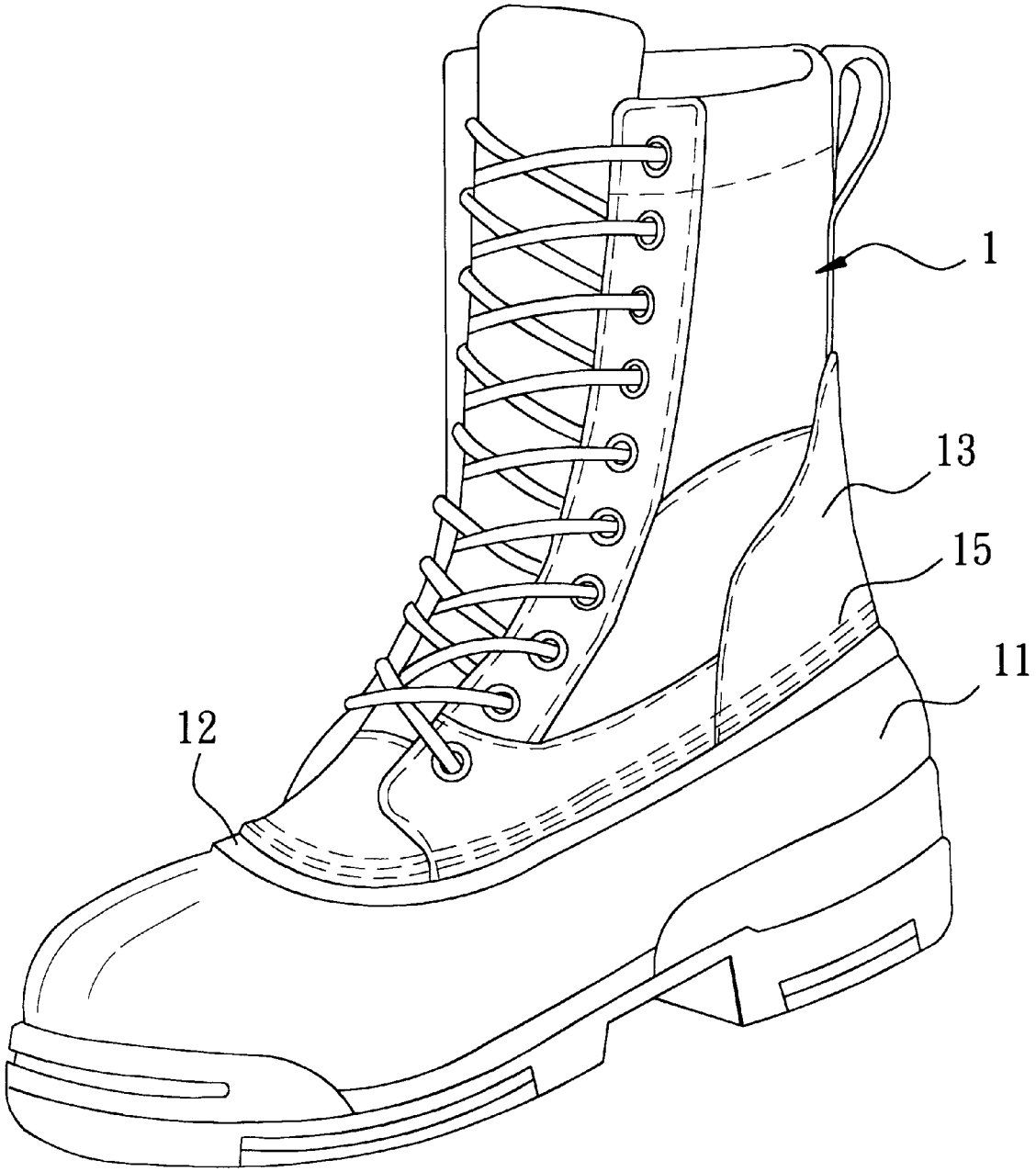
FIG. 1 is a perspective view of a boot embodying the present invention.
Figure 2:
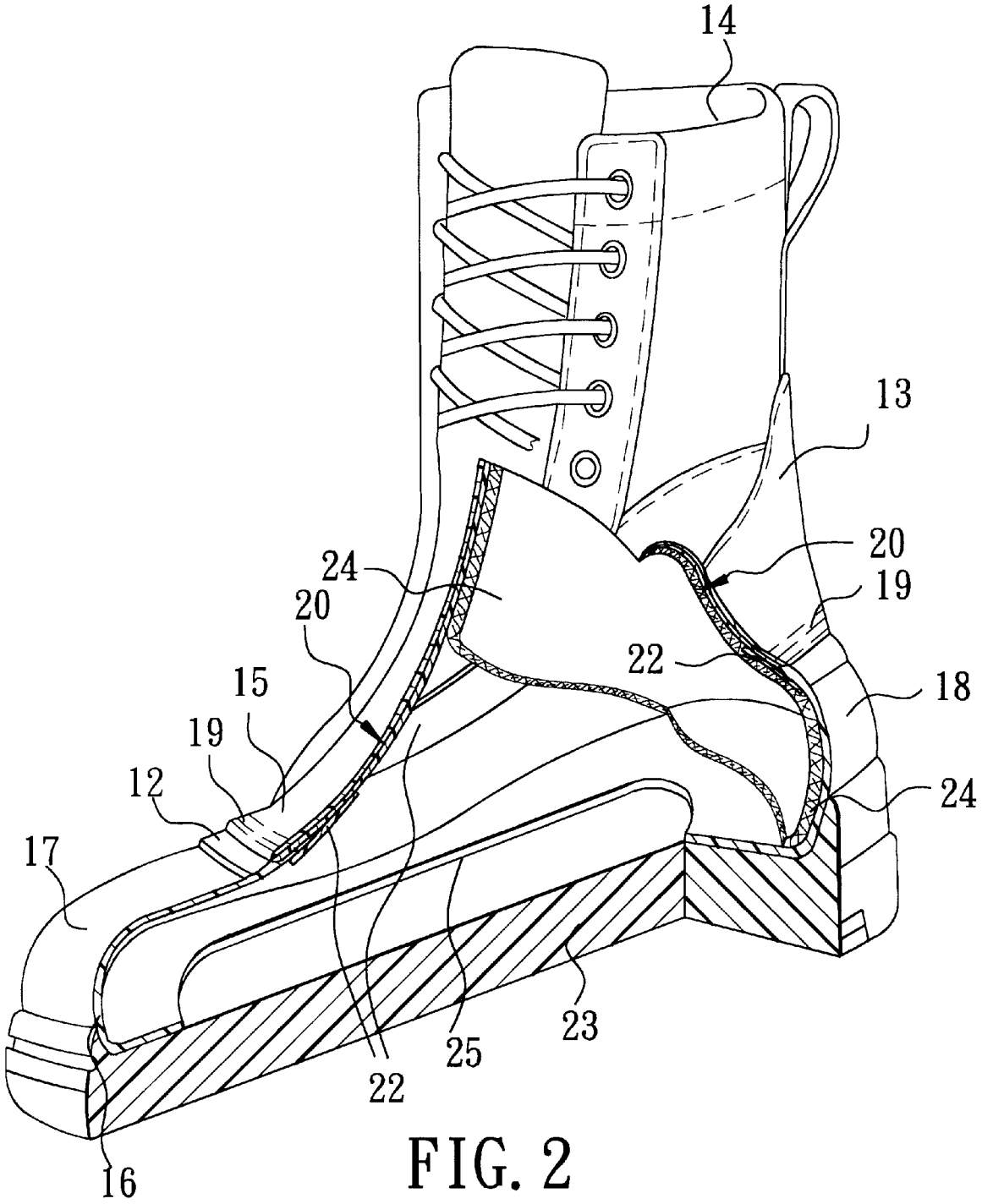
FIG. 2 is a partially sectioned view of the boot.
Figure 3:
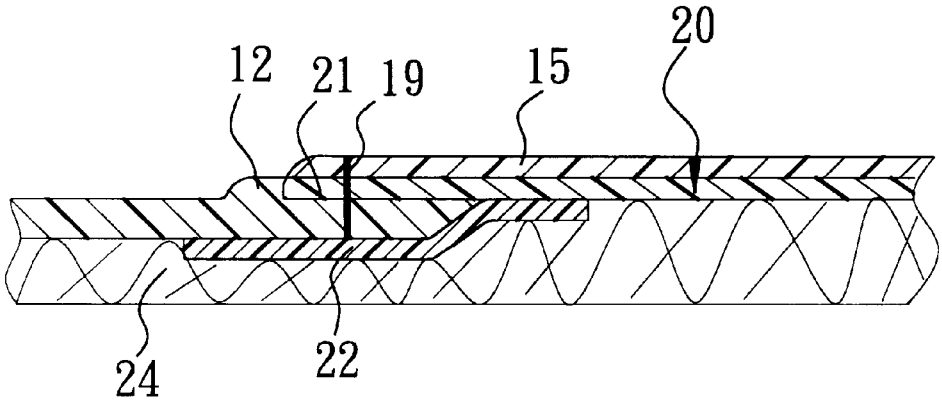
FIG. 3 is an enlarged view of a portion of the boot.

Referring to FIGS. 1, 2 and 3, a boot 1 embodying the present invention is shown to comprise an upper enclosure 13 to form an upper of the boot, and a lower enclosing shell 11 to define a lower of the boot. The upper enclosure 13 includes a top open end 14 and a bottom open end 15 and is formed from a plurality of tailored parts that are stitched to each other. The lower enclosing shell 11 is a one-piece molded shell made of a water-proof material. The lower enclosing shell 11 has an upper open end 12, a lower end 16, a toe portion 17 and a heel portion 18 connected to the toe portion 17 between the upper and lower ends 12, 16. The upper open end 12 of the lower enclosing shell 11 is to be connected to the bottom open end 15 of the upper enclosure 13.

Figure 4:
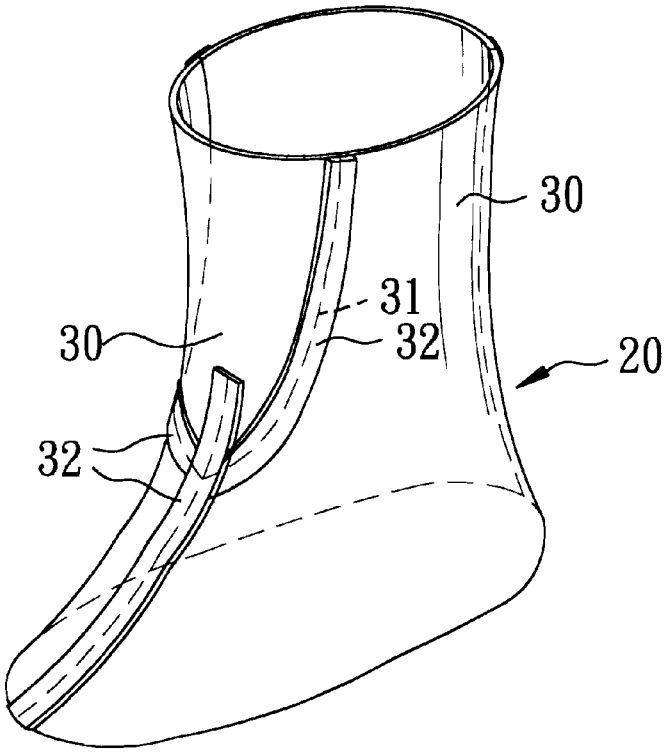
FIG. 4 is a view illustrating an inner lining sleeve used in the boot.

An inner lining sleeve 20 is provided inside the upper enclosure 13 to line the upper enclosure 13. The inner lining sleeve 20 has a bottom open end 21 that extends along the bottom open end 15 of the upper enclosure 13. The top end of the inner lining sleeve 20 extends to the top open end 14 of the upper enclosure 13. Preferably, a waterproof and gas-permeable or breathable material is used to make the inner lining sleeve 20. The inner lining sleeve 20 may be fabricated from a plurality of tailored parts 30 which are interconnected via stitched joints 31. The stitched joints 31 are sealed by joint sealing members 32 so as to be waterproof, as shown in FIG. 4.

A stitched seam 19 is provided among the upper enclosure 13, the inner lining sleeve 20 and the lower enclosing shell 11 to interconnect the bottom open end 15 of the upper enclosure 13, the bottom open end 21 of the inner lining sleeve 20 and the upper open end 12 of the lower enclosing shell 11. The upper open end 12 of the lower enclosing shell 11 is disposed interiorly of the bottom open end 21 of the inner lining sleeve 20.

A seam sealing member 22 is provided along and interiorly of the stitched seam 19 and is in contact with the inner surfaces of the inner lining sleeve 20 and the lower enclosing shell 11. The seam sealing member 22 is waterproof and serves to prevent water from penetrating through the stitched seam 19 into the interior of the inner lining sleeve 20 and the lower enclosing shell 11.

The lower end 16 of the lower enclosing shell 11 is opened to facilitate tooling operations for sewing and sealing the upper enclosure 13, the inner lining sleeve 20 and the lower enclosing shell 11. The lower end 16 is further flanged inwardly for reinforcing purposes. This opened and flanged lower end 16 confines an access opening 25 which provides an easy access to the inside of the lower enclosing shell 11 for tooling. An outsole 23 is attached to the lower end 16 of the lower enclosing shell 11 in a water-tight sealing relationship.

Figure 5:
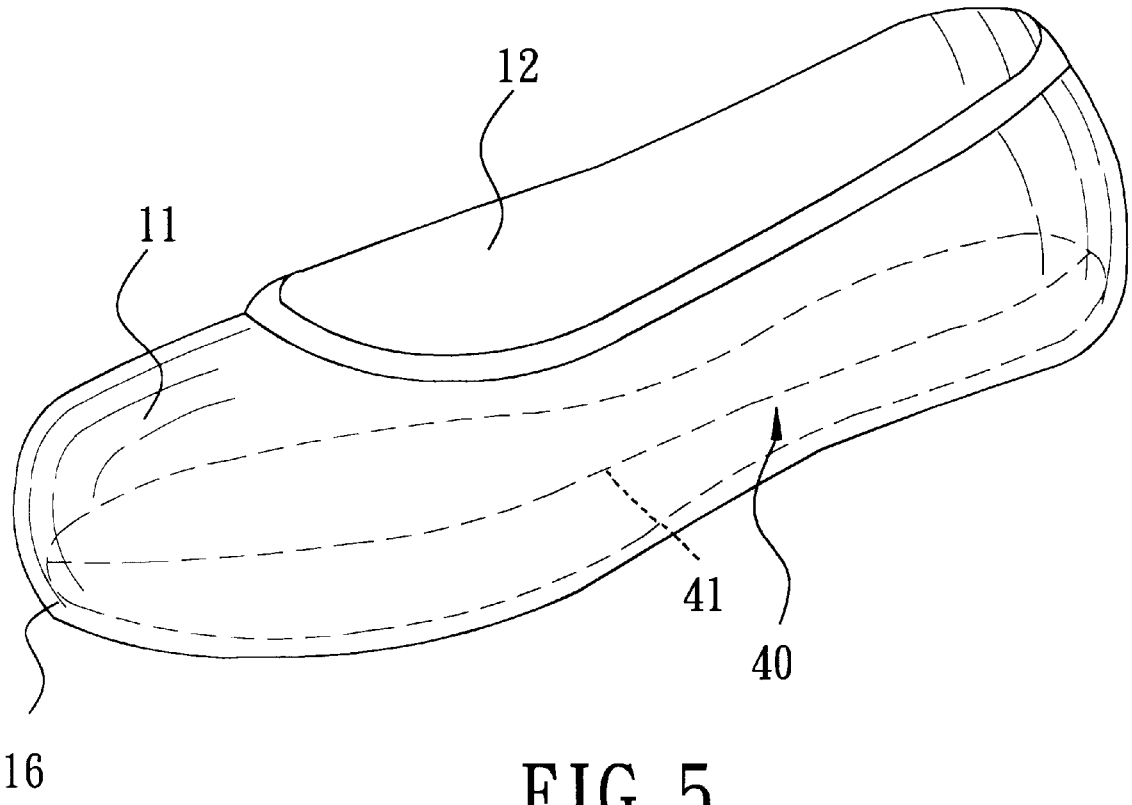
FIG. 5 illustrates an alternative lower enclosing shell of the boot.

Alternatively, the lower end 16 of the lower enclosing shell 11 may have an integrally molded insole 40 which is provided with a cut line 41, as shown in FIG. 5. The cut line 41 provides an access opening for tooling operations.

The lower enclosing shell 11 may also be a conventional lasted enclosing shell which is formed from a plurality of tailored waterproof parts and a plurality joints that interconnect the tailored parts and which has waterproof sealing means provided along the joints to ensure a waterproofing effect.

A sock-like inner lining member 24 is disposed inside the upper enclosure 13 and the lower enclosing shell 11 interiorly of the inner lining sleeve 20.

The boot constructed according to the present invention has an advantage in that the boot exhibits a good waterproof property even when the upper enclosure 13 of the upper of the boot is fabricated from an inexpensive breathable non-waterproof material and the stitched joints in the upper enclosure 13 are not provided with water-tight seals. Furthermore, since the seam-sealing member 22 is attached to the inner surfaces of the lower enclosing shell 11 and the inner lining sleeve 20, the seam-sealing member 22 can effectively prevent water permeation through the stitched seam 19 to the interior of the inner lining sleeve 20 and the lower enclosing shell 11. However, the stitched seam 19 allows water permeation from a location between the upper enclosure 13 and the inner lining sleeve 20 to the exterior of the boot. Thus, even when water is present between the inner lining sleeve 20 and the upper enclosure 13, the water can flow out through the stitched seam 19.

A method of providing a seam sealing member 22 to the inner surfaces of the boot 1 is described as follows: After the upper enclosure 13, the inner lining sleeve 20 is fastened to the lower enclosing shell 11 to form an assembly, the stitched seam 19 formed thereby may be sealed watertight by turning inside out the assembly of the upper enclosure 13, the inner lining sleeve 20 and the lower enclosing shell 11 so as to expose the inner surfaces of the inner lining sleeve 20 and the lower enclosing shell 11. As such, the process of sealing the stitched seam 19 can be carried out externally without extending tools into the inside of the boot.

The lower enclosing shell 11 used in the method may be one which has a closed lower end. To facilitate the process of turning inside out the fastened upper enclosure 13, the inner lining sleeve 20 and the lower enclosing shell 11, the materials used therefor should be considerably flexible.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A foot covering comprising:

an upper having an upper enclosure which includes a top open end and a bottom open end and which is formed from a plurality of tailored parts that are stitched to each other;

a lower having a lower enclosing shell which is made of a molded waterproof material, said lower enclosing shell including an upper open end, a lower end, a toe portion, and a heel portion connected to said toe portion between said upper open end and said lower end;

an inner lining sleeve which is made of a waterproof material, disposed inside said upper enclosure to line said upper enclosure, said inner lining sleeve having a bottom open end that extends along said bottom open end of said enclosure;

stitched seam means provided among said upper, said inner lining sleeve and said lower to interconnect said bottom open end of said upper enclosure, said bottom open end of said inner lining sleeve and said upper open end of said lower enclosing shell;

seam sealing means provided along said stitched seam between said inner lining sleeve and said lower enclosing shell, said seam sealing means being in contact with inner surfaces of said inner lining sleeve and said lower enclosing shell for preventing water permeation through said stitched seam into the interior of said inner lining sleeve and said lower enclosing shell, said stitched seam being water-permeable in an outward direction from a location between said inner lining sleeve and said upper enclosure; and an outsole attached to said lower end of said lower enclosing shell.

2. The foot covering as claimed in claim 1, wherein said upper open end of said lower enclosing shell is disposed interiorly of said bottom open end of said inner lining sleeve.

3. The foot covering as claimed in claim 1, wherein said inner lining sleeve is formed from a plurality of tailored parts and a plurality of stitched joints that interconnect said tailored parts.

4. The foot covering as claimed in claim 3, wherein said inner lining sleeve further has a plurality of joint sealing members provided along said stitched joints.

5. The foot covering as claimed in claim 1, wherein said outsole and said lower end of said lower enclosing shell are interconnected in a water-tight sealing relationship.

6. The foot covering as claimed in claim 1, wherein said lower end of said lower enclosing shell is flanged inwardly for reinforcement.

7. The foot covering as claimed in claim 1, further comprising a sock-like inner lining member disposed inside said upper enclosure and said lower enclosing shell interiorly of said inner lining sleeve.

8. A foot covering comprising:

an upper having an upper enclosure which includes a top open end and a bottom open end and which is formed from a plurality of tailored parts that are stitched to each other;

a lower having a lower enclosing shell which is made of a waterproof material, said lower enclosing shell including an upper open end, a lower end, a toe portion, and a heel portion connected to said toe portion between said upper open end and said lower end;

an inner lining sleeve which is made of a waterproof material, disposed inside said upper enclosure to line said upper enclosure, said inner lining sleeve having a bottom open end that extends along said bottom open end of said upper enclosure;

stitched seam means provided among said upper, said inner lining sleeve and said lower to interconnect said bottom open end of said upper enclosure, said bottom open end of said inner lining sleeve and said upper open end of said lower enclosing shell;

seam sealing means provided along said stitched seam between said inner lining sleeve and said lower enclosing shell, said seam sealing means being in contact with inner surfaces of said inner lining sleeve and said lower enclosing shell for preventing water permeation through said stitched seam into the interior of said inner lining sleeve and said lower enclosing shell, said stitched seam being water-permeable in an outward direction from a location between said inner lining sleeve and said upper enclosure; and an outsole attached to said lower end of said lower enclosing shell.

9. A method for making a foot covering comprising:

providing an upper having an upper enclosure which includes a top open end and a bottom open end and which is formed from a plurality of tailored parts that are stitched to each other;

providing a lower having a lower enclosing shell which is made of a waterproof material, said lower enclosing shell including an upper open end, a lower end, a toe portion, and a heel portion connected to said toe portion between said upper open end and said lower end;

providing an inner lining sleeve which is made of a waterproof material, disposed inside said upper enclosure to line said upper enclosure, said inner lining sleeve having a bottom open end that extends along said bottom open end of said upper enclosure;

fastening said upper enclosure and said inner lining sleeve to said lower enclosing shell by stitching the same together, thereby forming an assembly with stitched seam means among said upper enclosure, said inner lining sleeve and said lower enclosing shell;

turning inside out said assembly so as to expose inner surfaces of said inner lining sleeve and said lower enclosing shell; and sealing said stitched seam means by attaching seam sealing means to said inner surfaces along said stitched seam means.

10. The method of claim 9, wherein said lower end of said lower is a closed lower end.

* * * * *